US005419264A

United States Patent [19]

Davis

[11] Patent Number: 5,419,264

[45] Date of Patent: May 30, 1995

[54] BACKSPLASH MOLDING AND METHOD OF MANUFACTURING THE SAME

[76] Inventor: Stanley A. Davis, 955 Solitude Ave., Albertville, Ala. 35950

[21] Appl. No.: 62,792

[22] Filed: May 17, 1993

[51] Int. Cl.[6] ..... A47B 17/00

[52] U.S. Cl. ..... 108/27; 312/140.1

[58] Field of Search ..... 108/27, 42; 312/140.3, 312/140.1; 52/829, 822, 823, 824, 34, 35

[56] References Cited

U.S. PATENT DOCUMENTS 2,646,326 7/1953 Stanitz ..... 108/27

4,126,365 11/1978 Bryant ..... 108/27

*Primary Examiner*—Kenneth J. Dorner

*Assistant Examiner*—Gerald A. Anderson

*Attorney, Agent, or Firm*—Veal & Marsh

[57] ABSTRACT

A backsplash molding for counter tops and method for manufacturing the backsplash molding and related edge molding. The backsplash molding fits over the top of a retainer strip in a dovetail manner. This retainer strip affixes to a wall or is formed within the framework of a cabinet. Finished retainer strips and elongated strips are formed from a single piece of substrate material. The strips are shaped, laminated and cut to produce a finished backsplash element and a finished edge molding for installation with a counter top.

11 Claims, 8 Drawing Sheets

27
29
28
32
23
31
13
33
37
36
39
39
41
26
17'
23
21
39
24
17
39
18
13
22
11
12
21

BACKSPLASH MOLDING AND METHOD OF MANUFACTURING THE SAME

FIELD OF THE INVENTION

This invention relates to a backsplash and molding attachment for counter tops and the like. In greater particularity, the invention relates to a backsplash which interconnects with a grooved retainer strip that may be built into a cabinet or affixed to a wall. In even greater particularity, the present invention relates to a economically efficient method of manufacturing the backsplash molding and related edge molding.

Background of the Invention

Backsplash moldings are commonly used on the back of a counter top in kitchens, lavatories, laboratories and restaurants. These backsplashes are normally upstanding members or short walls mounted to the back of the counter tops Or affixed to an adjacent wall to prevent liquids and other debris from entering the area between the counter top and the wall.

In the past, these backsplash moldings have been used in devices such as those found in U.S. Pat. No. 2,785,937 issued to Murray and U.S. Pat. No. 3,007,213 issued to Hobbs. These and other backsplash moldings are adequate in preventing liquid and debris from entering the junction of the counter top and the wall. However, such backsplash moldings require elaborate methods of labor-intensive installation.

One problem associated with current backslash molding as well as counter top edge molding is appearance. Often, a counter top abuts a wall and utilizes no backsplash element. Instead, a plastic cove molding covers the gap between the counter top and the wall. The cove molding is unsightly and easily becomes detached from the gap. Similarly, when self is edging applied to the front of the counter top, it must be hand filed flush with the counter and tends to come loose with moisture. Soon the self edging becomes unsightly and nonfunctional.

Other methods for backsplash molding include the use of a ceramic tile placed against the wall and the counter. These tiles are expensive and labor intensive to install as the top edge must be molded and the tiles caulked. Ceramic tiles often do not match the laminate of the counter top surface, thus presenting an undesirable appearance. In some instances, self edging is applied to a counter top prior to the lamination of the counter top. The excess laminate such as formica is then routed off leaving chipped and burred edges which must then be hand filed for good appearance. Most of the above methods for installing counter tops require a near perfect fit between the walls and the counter top surface which limit counter top designs. All of the above methods require intensive labor initially as well as time for rework and servicing. The methods are expensive due to the labor and material waste associated with such methods. The resulting counter tops are often esthetically unpleasing or simple designs which are not desired by the customer.

An easy, inexpensive method for installation and manufacture of the backsplash molding is needed the area of home building and home improvement.

SUMMARY OF THE INVENTION

It is an object of this invention to provide an improved backsplash molding for sealing the rear area of counter top which abuts an adjacent wall.

Another object of this invention is to provide a backsplash molding that is simple and inexpensive to install in combination with a counter top.

Still another object of this invention is to provide a backsplash molding that can be integrated as part of the construction of the cabinets to which these backsplash moldings are affixed.

Yet another object of this invention is to provide a backsplash molding in which the counter top adjusts within a retainer strip to compensate for out-of-square walls.

Another object is to provide backsplash molding for a variety of counter top configurations with no noticeable seams present in the formica.

A further object of this invention is to provide an economical method of manufacturing the backsplash molding, a retainer strip, and a related edge molding in one operation.

These and other objects of the present invention are accomplished through the use of a elongated backsplash element which engages and seals a counter top. This backsplash element has a downwardly opening groove extending along a lower end defined by a front channel portion and rear channel portion of the backsplash element.

An elongated retainer strip can be affixed to a wall or formed within the frame of cabinet. The retainer strip has an elongated horizontal groove cut therein to receive the edge of a counter top. This edge of the counter top adjusts within the groove to compensate for irregular or out-of-square walls. The front edge of the counter top is then maintained square and true with adjacent counters or fixtures for a better overall appearance. The retainer strip also has an upwardly extending tongue along the entire upper surface. The tongue engages and interconnects with the downwardly opening groove formed in the lower surface of the backsplash element. A lower surface of the front channel portion abuts the planar surface of the counter top to form a junction and seal the rear edge of the counter top. The tongue of the retainer strip is shaped to form a beveled channel between the retainer strip and the wall, and, the rear portion nests within the beveled channel to hold the backsplash element in relation to the retainer strip.

The backsplash molding can be manufactured in a method that produces a related edge molding piece. The method involves cutting a T-shaped groove in substrate material and sawing the substrate material into elongated strips.

Simultaneously, a portion of the substrate material is moved over mushroom routers and shaped to form finished retainer strips. Elongated strips of substrate material with T-shaped grooves are shaped and laminated. A longitudinally extending rectangular groove is cut in elongated strips between the T-shaped groove and an edge of the elongated strip. Finally, a cut is made longitudinally coincident with the edge of the T-shaped groove creating a final backsplash element and an edge finished molding.

BRIEF DESCRIPTION OF THE DRAWINGS

Apparatus embodying features of the present invention are depicted in the accompanying drawings which form a portion of this disclosure and wherein.

DESCRIPTION OF THE PREFERRED EMBODIMENT

Figure 1:
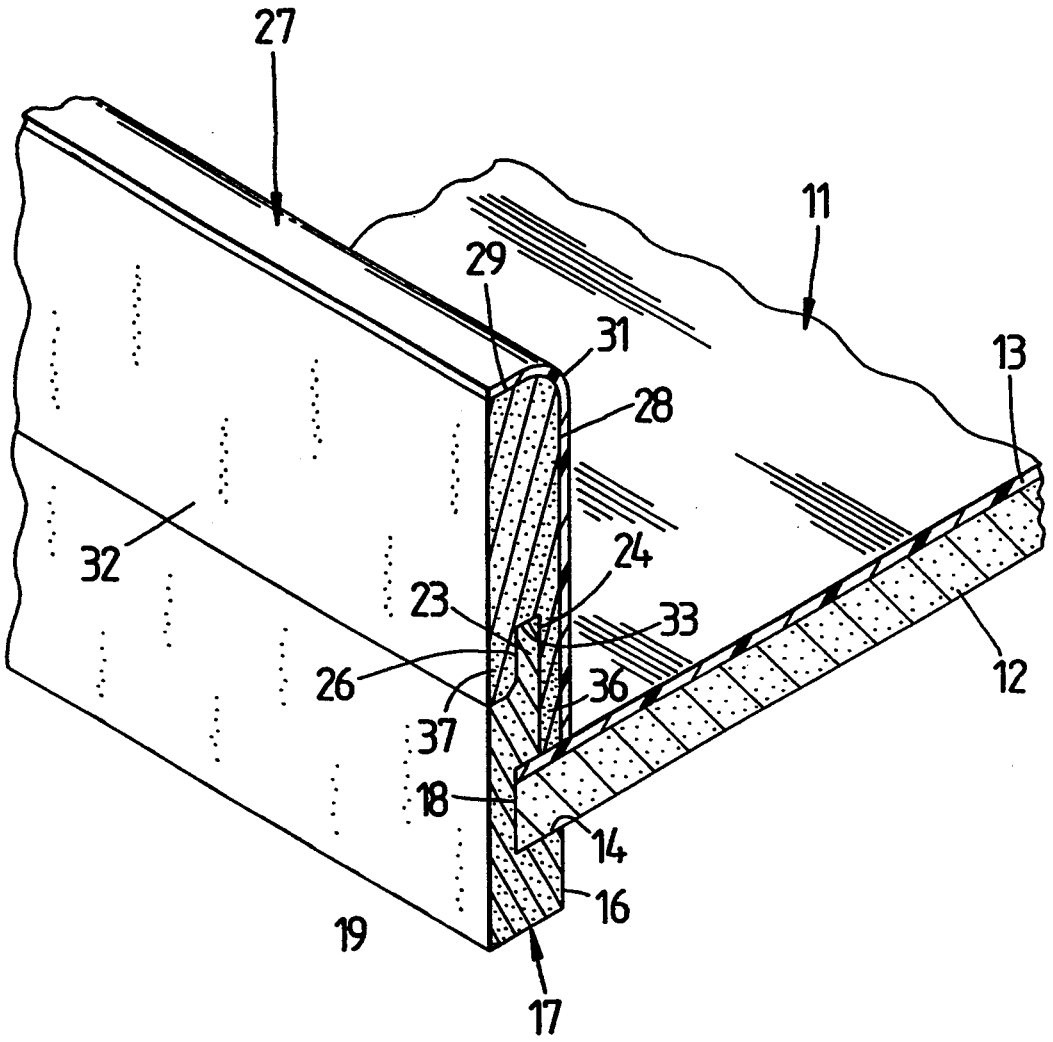
FIG. 1 is a perspective view of the backsplash element retain strip and counter top in place.

Referring to the drawings for a clearer understanding of the invention, it may be seen in FIG. 1, that part of a counter top 11 is formed from substrate material 12 such as wood MDF Board, PVC or similar materials and is covered with a sheet of decorative laminate 13 such as formica. The edges of the counter top 11 are not covered with formica. Retainer strip 17 has a flat rear face 19 and is fastened to a wall 21. A square groove 14 is cut or formed in the front face 16 of the elongated retainer strip 17 and accepts the rear edge 18 of counter top 11. An upwardly extending tongue 23 is formed along the top of retainer strip 17 and is spaced outwardly from wall 21. Tongue 23 has a flat front surface 24 and a beveled rear portion 26.

An elongated backsplash element is generally designated by the reference number 27. This backsplash element 27 is formed from substrate material 12 and has a front face 28 and rounded top 29 both of which are covered with a thin layer of laminate 31 such as formica. The rear surface 32 of backsplash element 27 is flat as seen in FIG. 1.

The backsplash element 27 has a downwardly opening vertical groove 33 cut or formed longitudinally therein. The downwardly opening vertical groove 33 is defined in a lower end 34 of backsplash element 23 by two spaced apart channel portions 36 and 37. Front channel portion 36 is part of the front face 28 of backsplash element 27 and as such is covered with a layer of laminate 31. The lower surface 38 of front channel portion 36 engages an upper surface 13 of the counter top 11. The rear channel portion 37 of the lower end 34 of backsplash element 27 is shorter than front portion 36 as some of the substrate material 12 is removed at the lower end 34 of the backsplash element 27.

The retainer strip 17 has a rear flat face 19 connected to a wall 21 by fasteners 39. The edge 18 of counter top 11 is received within the square groove 14 formed or cut in the front face 16 of retainer strip 17. It can been seen in FIG. 2 that the tongue 23 of the retainer strip 17 forms a channel 41 with the wall 21. The elongated backsplash element 27 is placed in an upright position on retainer strip 17 with the rear surface 32 against the wall 21. The lower portion 34 of backsplash element 27 fits over the top of retainer strip 17 in a dovetail manner with tongue 23 nesting within the downwardly opening vertical channel 33 of the backsplash element 27. With the bottom 38 of the front channel portion 36 resting on surface 13 of counter top 11, the rear channel portion 37 is cooperatively secured within the channel 41 formed between the rear surface 26 of tongue 23 and wall 21 as last seen in FIG. 2. The rear channel portion 37 fits snugly within the channel 41 to hold backsplash element 27 in place. An adhesive is used to form a water tight seal between the bottom surface 38 of front channel portion 36 and the surface 13 of counter top 11.

Figure 3:
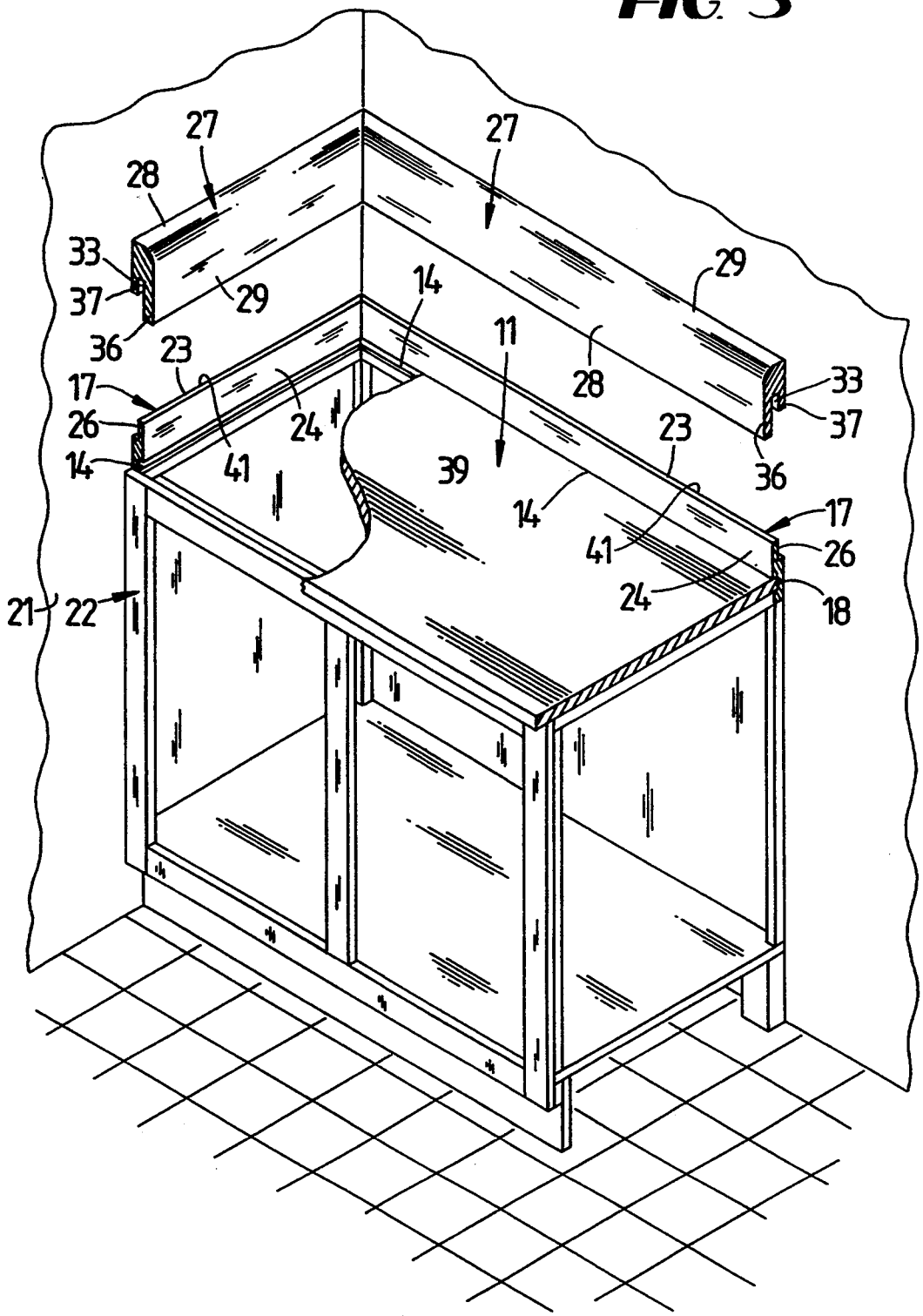
FIG. 3 is a perspective view of the retainer strip constructed within a cabinet frame.

The retainer strip 17 may also be built into the framework of a cabinet 22 as shown in FIG. 3. Edges of a counter top 11 are received within the square groove 14 of the surrounding retainer strip 17. The cabinet 22 can be set in place against a wall 21 and secured by a fasteners 39. The backsplash element 27 now fits over the top of the retainer strip 17 as described hereinabove.

Figure 9:
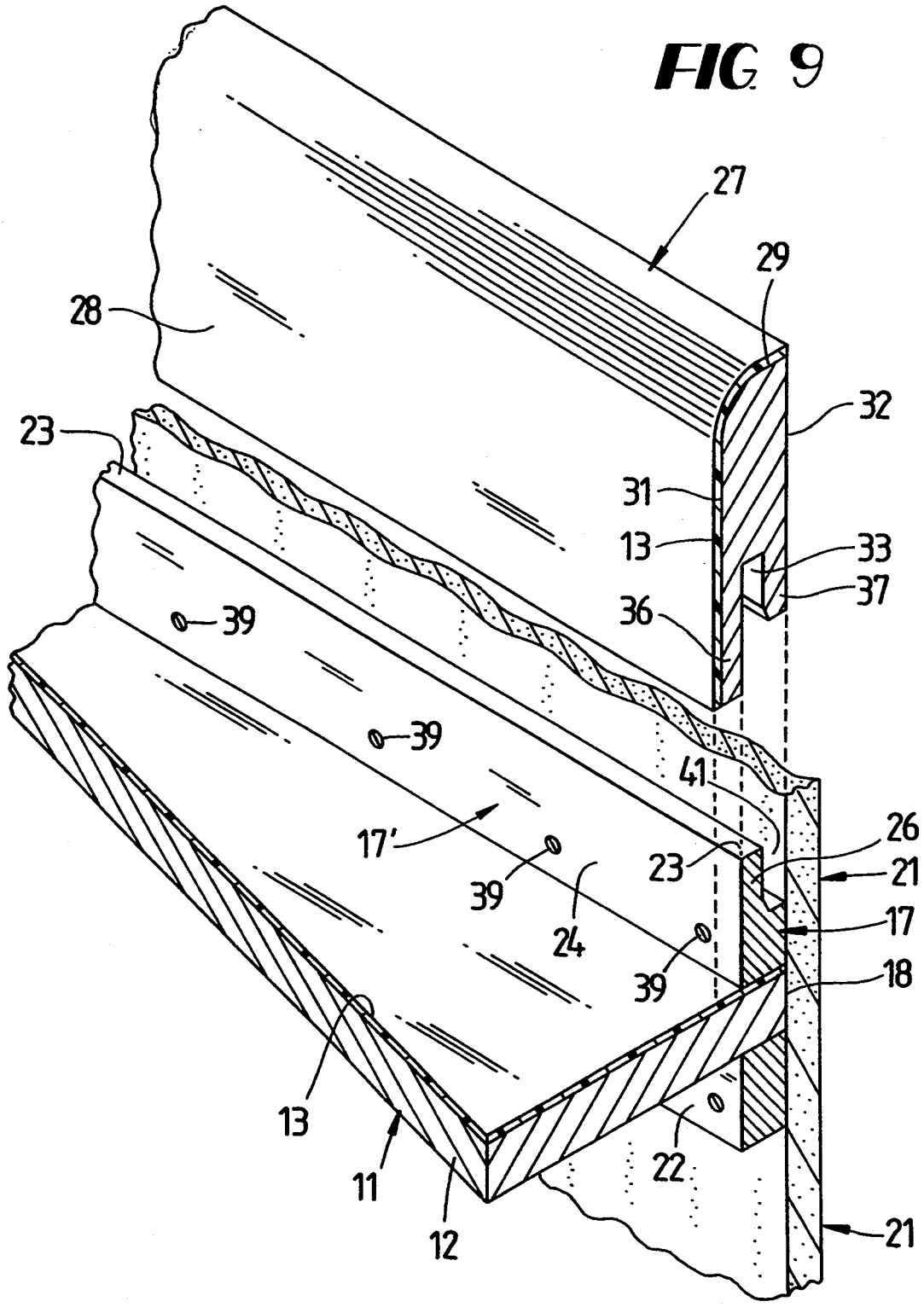
FIG. 9 is a perspective view of a retainer strip installed with an-existing counter.
Figure 10:
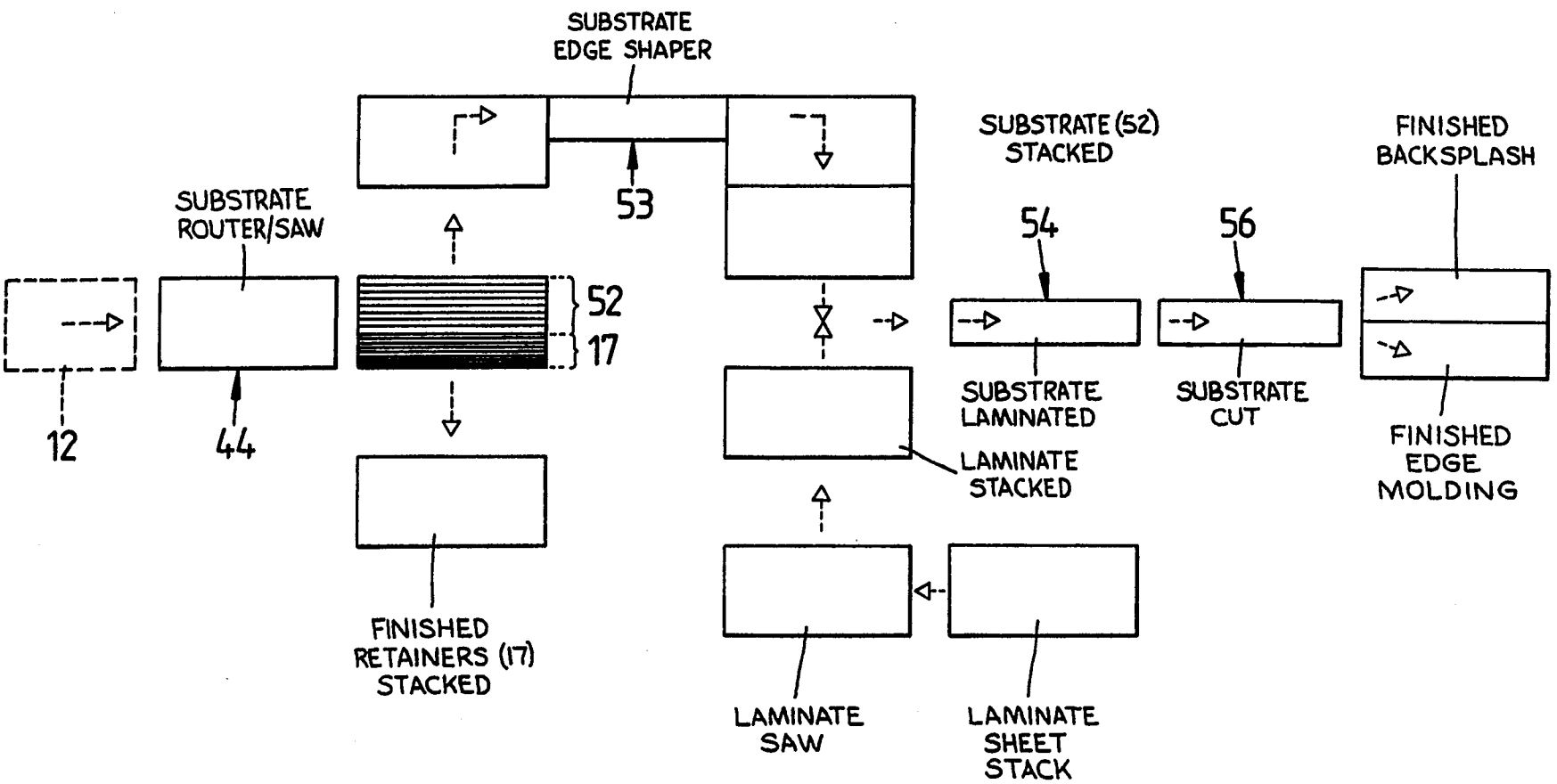
FIG. 10 is a flow chart of a method for manufacturing the presentation.

The retainer strip 17 may be cut longitudinally along a line coincident with a top edge of square groove 14. The top half 17' of retainer strip 17 rests upon a surface 13 of an existing counter top 11 and is held to wall 21 by fasteners 39. The backsplash element 27 engages the tongue 23 and groove 41 in a dovetail manner as described hereinabove and shown in FIG. 9.

METHOD FOR MANUFACTURING

Figure 4:
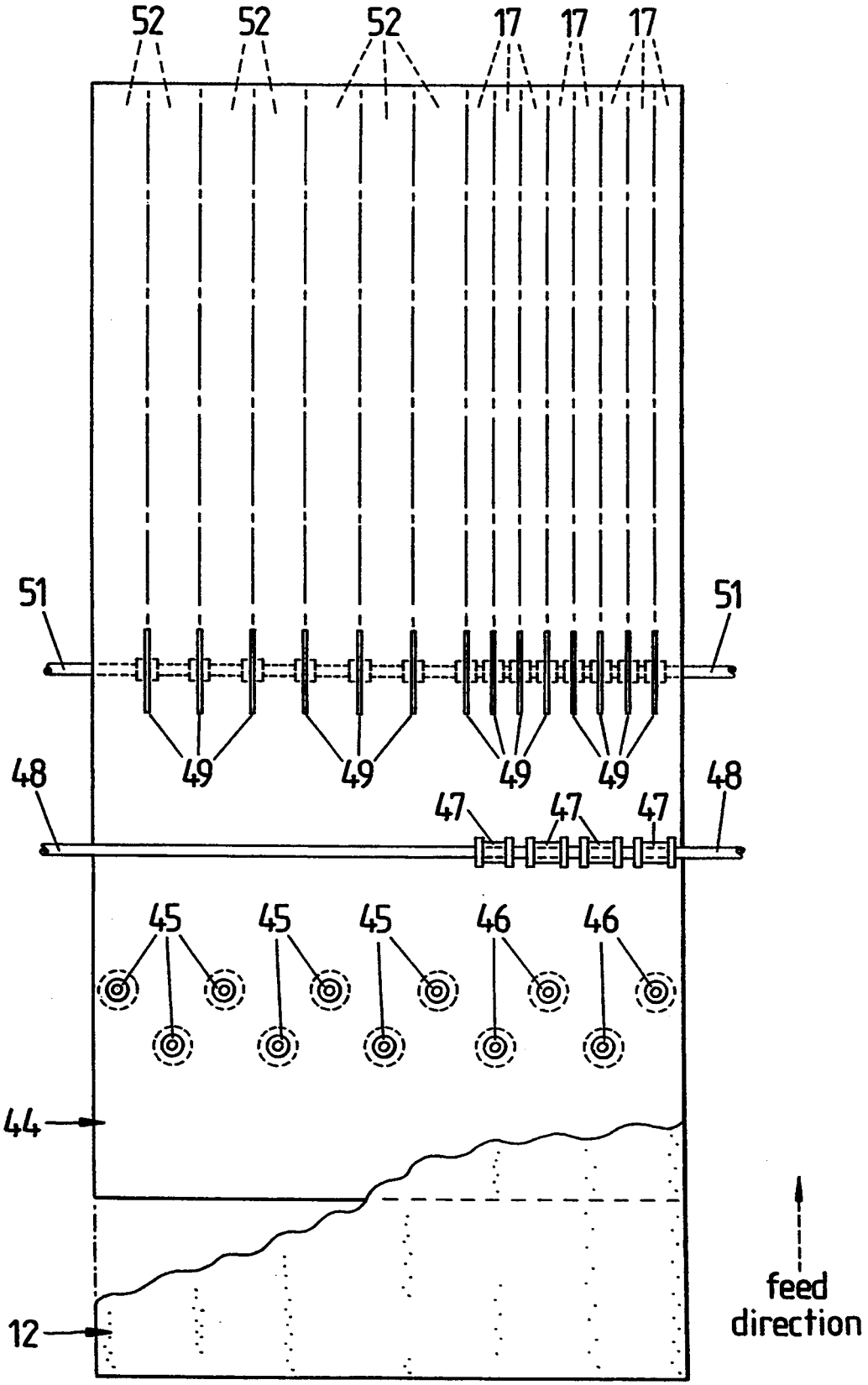
FIG. 4 is top plan view of the substrate material and routing machine.
Figure 11:
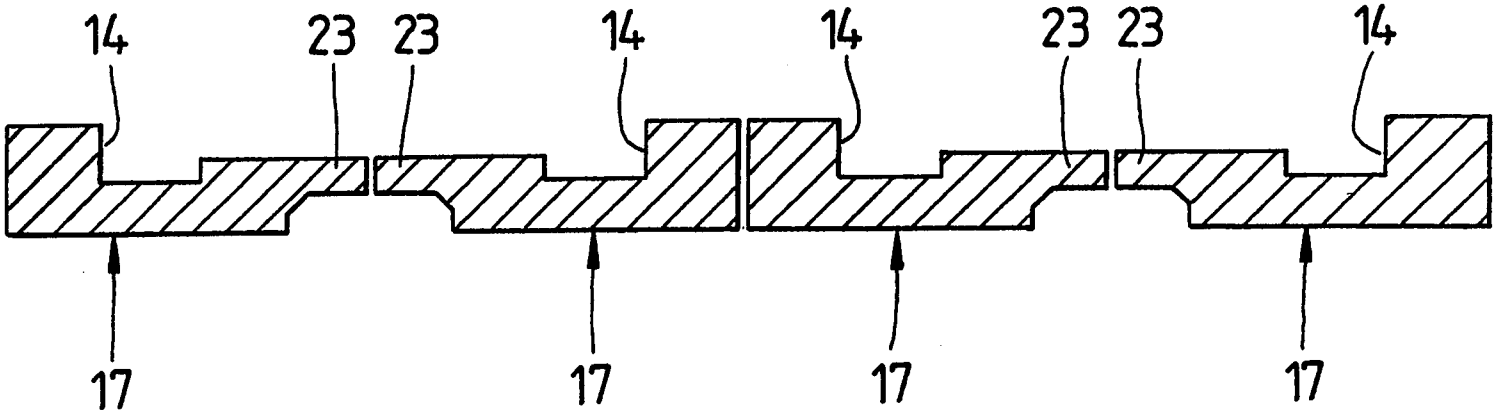
FIG. 11 is a sectional view of finished retainer strips as they come off a routing and shaping machine.

A method for manufacturing the backsplash element 27 is shown in FIGS. 4–8 and 10. In FIG. 4, a 5'×10' piece of substrate material 12, such as MDF board, is shown being placed on a machine 44. The substrate material 12 is then moved longitudinally over a plurality of routers 45. which cut longitudinal T-shaped slots 50 within a lower surface of substrate material 12. Simultaneously, an area of the substrate material 12 is moved longitudinally over a plurality of mushroom-shaped routers 46 as seen in FIG. 4. A set of shapers 47 mounted to an overhead shaft 48 shape the substrate material 12 which is moved longitudinally past mushroom-shaped routers 46. The substrate material 12 is then cut by saw blades 49 mounted to a shaft 51 into elongated strips 52 having longitudinal T-slot grooves and finished retainer strips 17. The finished retainer strips 17 shown in FIG. 11 are now ready for removal and packaging for later use in counter top fixtures.

Figure 2:
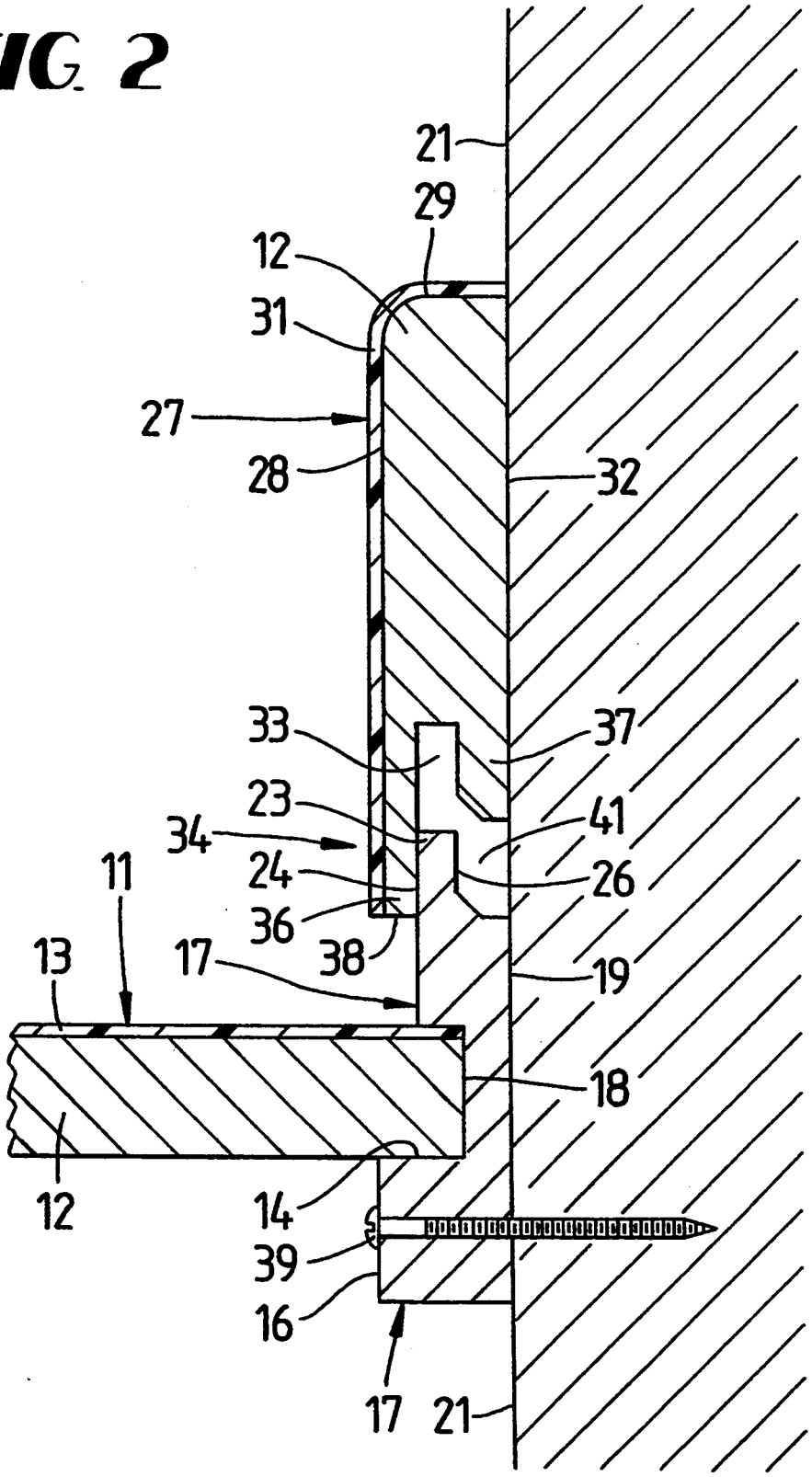
FIG. 2 is a sectional view of the backsplash element, retainer strip and counter top affixed to a wall.
Figure 5:
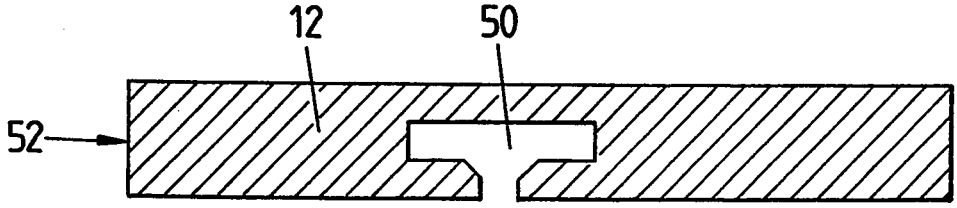
FIG. 5 is a sectional view of an elongated strip of substrate material.
Figure 6:
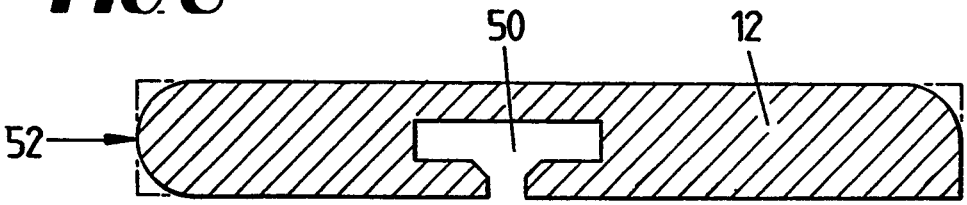
FIG. 6 is a sectional view of an elongated strip of substrate material after the edges have been shaped.
Figure 7:
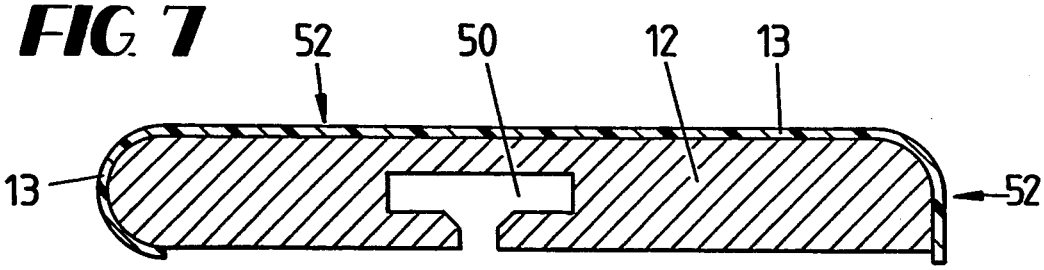
FIG. 7 is a sectional view of a laminated elongated strip of substrate material cut with a T-slot wall groover.
Figure 8:
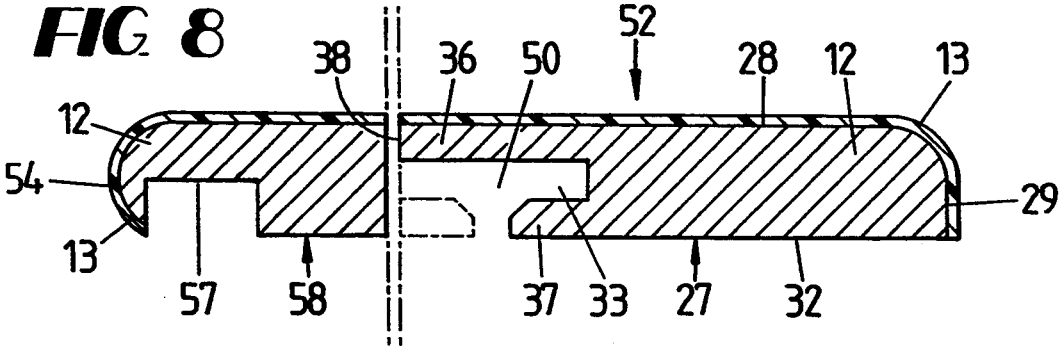
FIG. 8 is a sectional view of laminated substrate material sawed into two pieces forming a backsplash molding and a related edge trim molding.

A sectional view of the elongated strip 52 of substrate material 12 with T-shaped slot groove 50 formed by machine 44 is shown in FIG. 5. The elongated strip 52 is moved through an edge shaping machine 53 shown in FIG. 10, familiar to those skilled in the art, and the resulting elongated strip 52 is shown in FIG. 6. Next, the elongated strip 52 is laminated by a machine 54, shown in FIG. 10, known in the art which produces a laminated elongated strip 52 shown in FIG. 7. The laminated elongated strip 52 is moved through a machine 56, which routs excess laminate and cuts a longitudinally extending rectangular groove 57 in the lower surface of substrate material 12 between the T-shaped slot 50 and a longitudinal edge 55 of strip 52 as best seen in FIG.8. A longitudinally extending cut is made along a line coincident with an edge of the T-shaped slot 51 to form a backsplash element 27 and an edge molding 58 as best seen in FIG. 8. The edge molding element 58 is known in the art of counter top manufacturing and receives a front edge 15 of a counter top 11 within rectangular groove 57 to finish the counter top 11 as shown in FIG. 2. There is no need for self edging the counter top 11 and the edge molding 58 and backsplash elements can be matched or mixed in color without wasting laminate and substrate material 12.

While I have shown my invention in a few embodiments it will be obvious to those skilled in the art that it is not so limited but is susceptible of various changes and modifications without departing from the spirit thereof.

Having set forth the nature of the present invention, what is claimed is:

1. An improved cabinet structure integrating a backsplash molding with a counter top comprising, in combination:

(a) a cabinet frame positioned adjacent one or more walls of a room;

(b) an elongated backsplash element having a bottom surface defining a downwardly opening groove therein; and (b) an elongated retainer strip affixed to said wall at a height above said counter top having a tongue extending upward from an upper surface thereof vertically engaging said downwardly opening groove, an outwardly opening channel defined therein longitudinally along a front face thereof;

(c) a horizontally disposed counter top slidably received within said outwardly opening channel such that said backsplash element and said counter top are held in abutting substantially orthogonal relationship said backsplash held in substantially abutting relationship with said wall by said retainer strip and said counter top being horizontally adjustable within said channel to extend over said cabinet frame and to compensate for misalignment of said cabinet frame and one or more of said walls.

2. A backsplash molding for counter tops as defined in claim 1 wherein said backsplash element is held to said tongue of said retainer strip and said counter top by an adhesive.

3. A backsplash molding for counter tops and the like as defined in claim 1 wherein said backsplash element is formed from substrate material and covered with a decorative laminate.

4. An elongated backsplash element as defined in claim 1 wherein said downwardly opening groove is defined by a depending front portion and a depending rear portion.

5. A elongated retainer strip as defined in claim 1 wherein said tongue has a flat front face and rear face shaped such that said rear face forms a channel between said tongue and a wall.

6. A top for cabinetry including a molding for counter tops comprising:

(a) an elongated backsplash element having an elongated downwardly opening groove extending along a bottom surface thereof, said downwardly opening groove defined by a depending front portion and a depending rear portion; and (b) an elongated retainer strip affixed to a wall superjacent a cabinet and having a tongue extending upwardly from an upper surface thereof, said tongue having a rear face forming a channel between said tongue and said wall, said retainer strip having an outwardly opening channel extending along a front face thereof for slidably and adjustably receiving an edge of a planar counter top such that said depending front portion of said backsplash element abuts the top of said counter top.

7. A backsplash molding for counter tops as defined in claim 1 wherein said tongue of said retainer strip is received within said downwardly opening groove of said backsplash element such that backsplash element is supported in an upright position atop said retaining strip with said front portion of said backsplash element abutting an upper surface of said counter top and said rear channel portion of said backsplash element engaged between said tongue and said wall.

8. A backsplash molding for counter tops as defined in claim 7 wherein said backsplash element is held to said tongue of said counter top by a adhesive.

9. A backsplash molding for counter tops as defined in claim 8 wherein said retainer strip is held in place on a wall by fasteners

10. A top as defined in claim 6 wherein said backsplash element and said counter top are formed from substrate material and covered with decorative laminate such that intersecting surfaces of said backsplash element and said counter top yield a finished appearance.

11. A top as defined in claim 10 further comprising an edge molding having a curved upper surface, a channel formed in one surface for slidably and adjustably receiving an edge of said counter top therein, and a decorative laminate covering said curved upper surface and a surface opposite said channel such that said counter top, edge molding and molding element present a uniform finished appearance and can be adjusted horizontally relative to each other to compensate for misalignment of said cabinetry with said wall.

* * * * *

UNITED STATES PATENT AND TRADEMARK OFFICE

CERTIFICATE OF CORRECTION

PATENT NO. : 5,419,264

DATED : May 30, 1995

INVENTOR(S) : Stanley A. Davis

It is certified that error appears in the above-identified patent and that said Letters Patent is hereby corrected as shown below:

Column 1, line 22, change "Or" to "or".

Column 3, line 7, change "retain" to "retainer".

Column 3, line 27, delete "presentation" and insert -present invention-.

Column 4, line 68, change "51" to "50".

Signed and Sealed this

Eighth Day of August, 1995

*Attest:*

*Attesting Officer*

Bruce Lehman

BRUCE LEHMAN

*Commissioner of Patents and Trademarks*